US005291687A

United States Patent [19]

Abad

[11] Patent Number: 5,291,687

[45] Date of Patent: Mar. 8, 1994

[54] WINDOW TRACK DEBRIS ACCUMULATION PREVENTION SYSTEM

[76] Inventor: Alex Abad, 507 Earle La., Redondo Beach, Calif. 90278

[21] Appl. No.: 13,634

[22] Filed: Feb. 4, 1993

[51] Int. Cl.[5] ..... E05D 15/06

[52] U.S. Cl. ..... 49/404; 49/506; 29/235

[58] Field of Search ..... 49/404, 456, 506; 29/235, 451

[56] References Cited

U.S. PATENT DOCUMENTS

| | | | |
|---|---|---|---|
| 3,694,894 | 10/1992 | Jelinek et al. | 29/235 X |
| 4,029,354 | 6/1977 | Valeri | 29/451 X |
| 4,208,755 | 6/1980 | Shepherd | 49/404 X |
| 4,265,052 | 5/1981 | Johnson et al. | 49/404 X |
| 4,823,452 | 4/1989 | Cloutier | 29/235 |
| 4,829,652 | 5/1985 | Haas et al. | 29/235 X |
| 5,029,381 | 7/1991 | St. Angelo et al. | 29/235 X |
| 5,031,293 | 7/1991 | Goedderz et al. | 29/235 |
| 5,103,547 | 4/1992 | Holloway et al. | 29/235 X |
| 5,127,143 | 7/1992 | Urlacher | 29/235 |

*Primary Examiner*—Peter M. Cuomo
*Assistant Examiner*—Jerry Redman
*Attorney, Agent, or Firm*—Kelly, Bauersfeld & Lowry

[57] ABSTRACT

A window assembly including a sliding window supported within a U-shaped window track utilizes a compressible foam strip with memory to prevent the accumulation of debris in the window track. After the foam strip has been cut to the length of the window track, it is compressed and pressed into place so as to substantially fill the window track to prevent an accumulation of debris therein, and yet not interfere with movement of the sliding window. In this regard, the foam strip is fitted to the window track so that as the foam strip expands, its cross-sectional dimensions are such that the window may be supported on a window-supporting rail with little or no contact between the window and the foam strip. After debris which would otherwise have accumulated within the window track is collected on the foam strip, the foam strip is removed from the window track.

13 Claims, 1 Drawing Sheet

FIG. 1
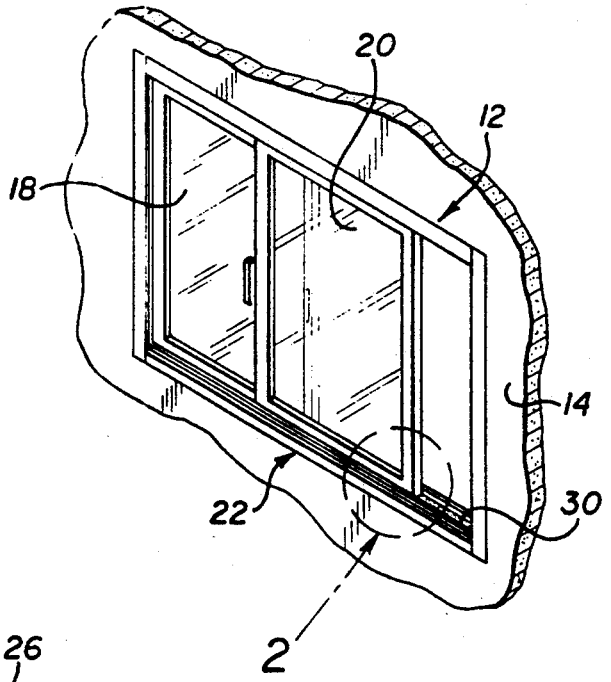
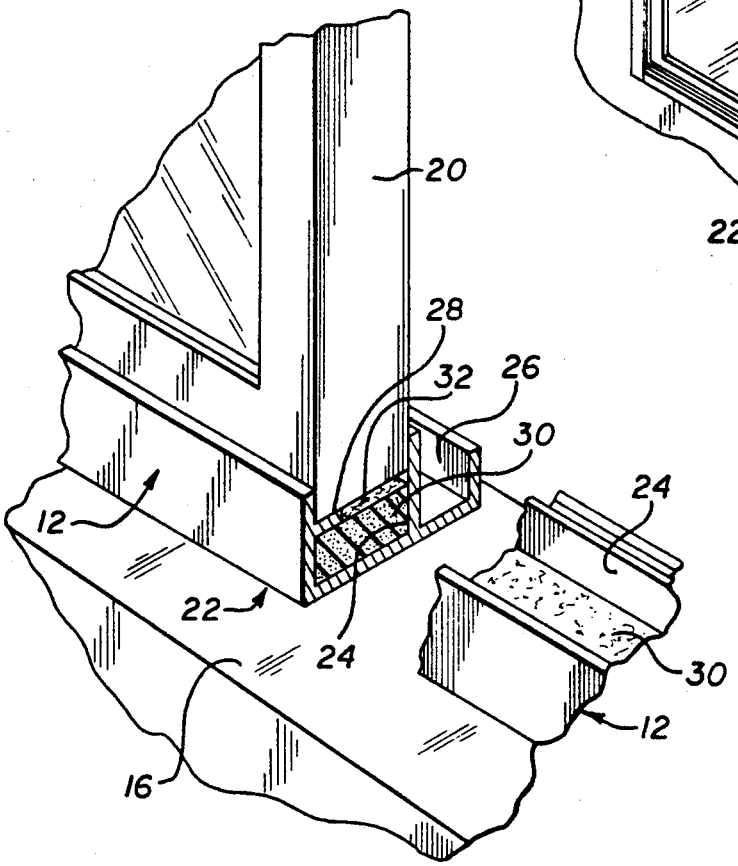
FIG. 2
FIG. 3
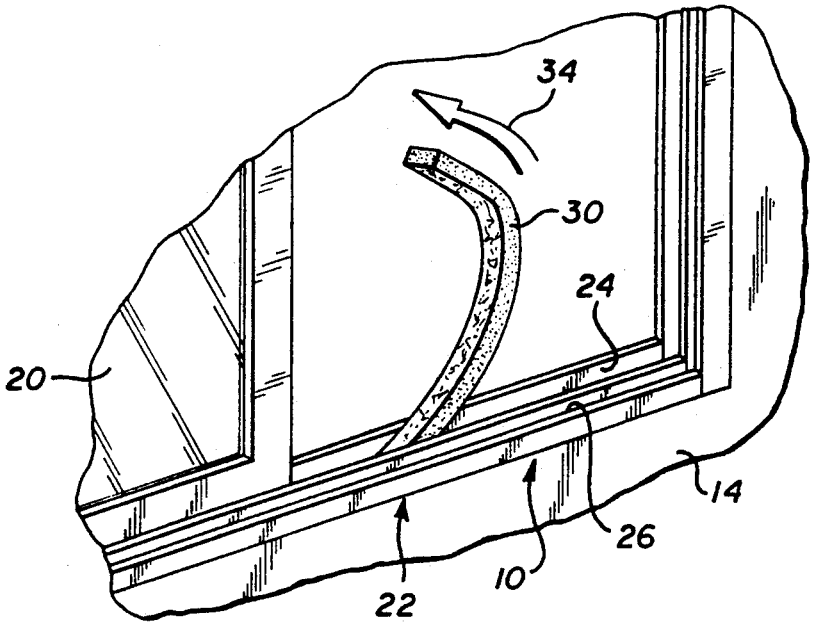

WINDOW TRACK DEBRIS ACCUMULATION PREVENTION SYSTEM

BACKGROUND OF THE INVENTION

This invention relates generally to sliding window assemblies. More particularly, the present invention relates to a process for preventing an accumulation of debris in a window track.

Following the completion of construction of a new home, it is a common practice that the contractor have the home thoroughly cleaned prior to the final walk-through by the new home buyer. This is also a common practice in the construction of new offices and in the remodeling of existing homes and offices. With respect to new homes, a crew of eight to ten people is typically employed to clean the home of construction debris, and may often spend three days or more cleaning a single house.

Some of the toughest and most time consuming areas to clean are the window tracks. An average house may have twenty windows or more, all of which are usually installed before the drywall is taped, the ceiling sprayed, the walls painted, etc. Construction debris such as sawdust, stucco, plaster, dirt, mud, paint and nails, tends to get into the window track. To clean the window track thoroughly of these materials, scrapers, steel wool and other implements must often be used.

In recognition of the problem associated with cleaning window tracks of construction debris, some window manufacturers have shipped windows to the construction site with a styrofoam plug placed within and generally filling the exposed portion of the window track. The primary drawback with this arrangement, however, is that as soon as a construction worker opens the window for ventilation, the styrofoam is broken and discarded. Hard plastic covers have also been placed over the window track to minimize the collection of debris, but, like the styrofoam plug, such rigid covers must be removed from the track in order to open the window. During construction the rigid covers tend to be discarded and never replaced.

Accordingly, there has been a need for a novel window assembly and a process capable of eliminating or greatly minimizing the amount of cleaning of window tracks required on completion of construction. Such an apparatus and process must be inexpensive, lend itself to use with existing sliding windows, remain in place without interfering with movement of a sliding window, and reliably prevent the accumulation of debris in the window track. The present invention fulfills these needs and provides other related advantages.

SUMMARY OF THE INVENTION

The present invention resides in a novel window assembly and a process for preventing an accumulation of debris in a window track. The assembly and process of the present invention are useful in home construction and improvement environments to prevent construction debris such as sawdust, stucco, plaster, dirt, mud, paint and nails from collecting inside the window tracks. The present invention is not limited to such an environment, however, since it is useful in keeping window tracks free of debris under virtually any condition.

The window assembly comprises, generally, a sliding window adapted to fit within a U-shaped window track, and removable means for substantially filling the track without interfering with movement of the sliding window. The removable track filling means prevents the accumulation of debris in the window track.

In a preferred form of the window assembly, the window includes a window-supporting rail over which the sliding window is supported. The removable track filling means includes a compressible foam strip with memory, which is dimensioned to fit within the window track below the window-supporting rail. The foam strip extends the length of the window track to insure that debris does not fall below the foam strip, but rather is collected on an upper surface thereof.

In accordance with the process for preventing an accumulation of debris in a window track, the length of the window track is measured by stretching the foam strip horizontally across the length of a window sill. The foam strip is then cut so that it is the length of the window track or slightly longer, and then pressed into the window track so as to substantially fill the window track and yet not interfere with movement of the sliding window. During the pressing step the foam strip is compressed and placed below the window-supporting rail. The foam strip is also fitted to the window track so that as the foam strip expands its cross-sectional dimensions are such that the window may be supported on the window-supporting rail and moved between open and close positions with little or no contact between the window and the foam strip. After debris has collected on an upper surface of the foam strip, it can be easily removed from the window track, and either discarded or cleaned and replaced within the window track.

When used with a horizontally sliding window, the foam strip may be compressed and slipped under the sliding window to completely fill the window track. Alternatively, the process of the present invention may include the steps of cutting the once measured and cut foam strip in half, moving the sliding window to a first extreme open or close position, and pressing a first half of the foam strip into a first exposed portion of the window track. The sliding window is then moved to a second extreme open or close position, and then a second half of the foam strip is pressed into a second exposed portion of the window track. the two halves of the foam strip are thereby positioned to substantially fill the window track and prevent an accumulation of debris therein, and yet neither will interfere with movement of the window.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a perspective view of a window assembly embodying the present invention, specifically showing from an exterior perspective a sliding window which moves within a U-shaped track horizontally relative to a stationary window;

FIG. 2 is an enlarged fragmented and partially sectional perspective view of the area 2 indicated in FIG. 1, illustrating the positioning of a compressible foam strip with memory within the window track and below a window-supporting rail, so as to substantially fill the window track to prevent an accumulation of debris therein, and yet not interfere with movement of the sliding window; and FIG. 3 is another fragmented exterior perspective view of the window assembly shown in FIGS. 1 and 2, illustrating the manner in which the foam strip is removed from the window track following construction and/or remodeling, after debris has accumulated on an upper surface of the foam strip.

DETAILED DESCRIPTION OF THE PREFERRED EMBODIMENT

As shown in the drawings for purposes of illustration, the present invention is concerned with an improved window assembly, generally designated in the accompanying drawings by the reference number 10. The improved window assembly 10 comprises a rectangular window frame 12 mounted to a building wall 14 and resting on a window sill 16. A fixed window 18 and a sliding window 20 are carried within the window frame 12 in a standard manner.

More particularly, the window frame 12 includes a lower frame member 22 which directly overlays the window sill 16. The lower frame member 22 is constructed to include a channel-like U-shaped sliding window track 24 and an adjacent parallel screen/window slot 26. The sliding window track 24 includes a rail 28 which extends horizontally inwardly into the track. The fixed window 18 and a screen (not shown) are positioned within a screen/window slot 26. The sliding window 20, on the other hand, is adapted to fit within the sliding window track 24 and is supported therein by the rail 28.

During home construction and remodeling, undesirable debris will often collect within the sliding window track. It will be noted from the design of the track 24 that the cleaning of debris such as sawdust, stucco, plaster, dirt, mud, paint, nails and so forth, from the window track can be quite difficult. For this reason it is desirable at times to prevent the accumulation of such debris in the window track 24 in a manner which will not interfere with moving the sliding window 20 between its open and close positions.

In accordance with the present invention, and as best shown in FIGS. 2 and 3, the window assembly 10 includes a compressible foam strip 30 with memory, which is dimensioned to fit within the window track 24 below the window-supporting rail 28, and extend the length of the window track. The foam strip 30 substantially fills the window track 24 without interfering with the movement of the sliding window 20, to effectively prevent an accumulation of debris in the window track. This is accomplished, primarily, by capturing the debris which would otherwise fall into the window track 24 on an upper surface of the foam strip 30 which, following construction of the home or at any other desirable time, may be removed from the window track and either disposed of or cleaned and then replaced within the window track. The foam strip 30, therefore, is well suited for use in a novel process for preventing an accumulation of debris in the window track.

By way of example, to accomplish the process of the present invention, the length of the window track 24 may be measured by stretching a roll of foam having the desired cross-sectional configuration, horizontally across the length of the window sill 16. The foam strip 30 is cut from the roll of foam material so that it is the length of the window track 24 or slightly longer. This helps to insure that when the foam strip 30 is properly placed, debris will not be allowed within the window track. The foam strip 30 is then compressed and pressed into the sliding window track 24 for placement below the window-supporting rail 28 so as to substantially fill the window track and yet not interfere with movement of the sliding window 20. Preferably the foam strip 30 is fitted to the window track 24 so that as the foam strip expands to fill the window track, its cross-sectional dimensions are such that a small gap 32 remains between the upper surface of the foam strip 30 and the bottom of the sliding window 20. This helps to insure that when the sliding window 20 is positioned over the rail 28, there is minimal contact between the window and the foam strip 30 such that the sliding window 20 may be moved between open and close positions without interference from the foam strip.

When a horizontally sliding window such as that shown in the accompanying drawings is encountered there are several different ways in which the foam strip 30 may be placed within the window track 24. For example, the foam strip 30 may be compressed and slipped under the sliding window 20 until it extends the entire length of the window track 24. Alternatively, the foam strip 30 may be cut in half whereupon after the sliding window is moved to a first extreme open or close position, the first half of the foam strip 30 is pressed into the first exposed portion of the window track 24, after which the sliding window is moved to a second extreme open or close position and then the second half of the foam strip is pressed into the newly exposed and unfilled portion of the window track.

The foam strip 30 may be left in place for the duration of the construction project during which undesirable debris is collected on an upper surface thereof. At any time when it is deemed desirable to do so, the foam strip 30 may be removed from the window track 24 by simply pulling it upwardly as indicated by the arrow 34 in FIG. 3, and either disposed of or cleaned and replaced within the window track.

From the foregoing it is to be appreciated that the improved window assembly 10 of the present invention offers significant advantages over prior rigid window track guards and covers which are either broken or simply removed when the sliding window 20 is opened. The process for preventing an accumulation of debris in a window track, in accordance with the present invention, is easy to understand and implement at the work site, and can be utilized with a wide variety of window types and designs. Moreover, the window assembly 10 of the present invention and the related process offer an economical solution to the problems encountered in the cleaning of window tracks, by eliminating the need to spend hours in cleaning such tracks throughout a house following construction.

Although a particular embodiment of the invention has been described in detail for purposes of illustration, various modifications may be made without departing from the spirit and scope of the invention. Accordingly, the invention is not to be limited, except as by the appended claims.

I claim:

1. A process for preventing an accumulation of debris in a window track, comprising the steps of:

measuring the length of the window track by stretching an elongate foam strip horizontally across the length of a window sill;

cutting the foam strip so that it is the length of the window track or slightly longer; and pressing the foam strip into the window track so as to substantially fill the window track to prevent an accumulation of debris therein, and yet not interfere with movement of a window, wherein during the pressing step the foam strip is compressed and slipped under a horizontally sliding window positioned within the window track.

2. A process as recited in claim 1, including the step of placing the foam strip below a window-supporting rail.

3. A process as recited in claim 2, including the step of fitting the foam strip to the window track so that as the foam strip expands to fill the window track, its cross-sectional dimensions are such that the window may be supported on the window-supporting rail and moved between open and close positions without interference from the foam strip.

4. A process as recited in claim 1, including the steps of cutting the once measured and cut foam strip in half, moving a horizontally sliding window to a first extreme open or close position, pressing a first half of the foam strip into a first exposed portion of the window track to substantially fill the first portion of the window track to prevent an accumulation of debris therein and yet not interfere with movement of the window, moving the sliding window to a second extreme open or close position, and pressing a second half of the foam strip into a second exposed portion of the window track so as to substantially fill the second exposed portion of the window track to prevent an accumulation of debris therein and yet not interfere with movement of the window.

5. A process as recited in claim 1, including the step of removing the foam strip from the window track after debris has accumulated on the foam strip.

6. A window assembly, comprising:

a window frame including a window sill having a U-shaped window track, the window track including a window-supporting rail;

a sliding window adapted to fit within the track when closed, the sliding window being supported on the rail within the window track; and removable means for substantially filling the track without interfering with the movement of he sliding window, whereby the removable track filling means prevents the accumulation of debris in the window track.

7. A window assembly as set forth in claim 6, wherein the removable track filling means comprises a compressible foam strip with memory.

8. A window assembly as set forth in claim 7, wherein the foam strip is dimensioned to fit within the window track below the window-supporting rail.

9. A window assembly as set forth in claim 8, wherein the foam strip extends the length of the window track 10. A process for preventing an accumulation of debris in a window track, comprising the steps of:

measuring the length of the window track by stretching an elongate foam strip horizontally across the length of the window sill;

cutting the foam strip so that it is the length of the window track or slightly longer;

pressing the foam strip into the window track so as to substantially fill the window track to prevent an accumulation of debris therein and yet not interfere with movement of a sliding window, wherein during said pressing step the foam strip is compressed and placed below a window-supporting rail;

fitting the foam strip to the window track so that as the foam strip expands to fill the window track, its cross-sectional dimensions are such that the window may be supported on the window-supporting rail and moved between open and close positions without interference with the foam strip; and removing the foam strip from the window track after debris has accumulated on the foam strip.

11. A process as recited in claim 10, wherein during the pressing step the foam strip is compressed and slipped under the sliding window positioned within the window track.

12. A process as recited in claim 10, including the steps of cutting the once measured and cut foam strip in half, moving the sliding window to a first extreme open or close position, pressing a first half of the foam strip into a first exposed portion of the window track to substantially fill the first portion of the window track to prevent an accumulation of debris therein and yet not interfere with movement of the window, moving the sliding window to a second extreme open or close position, and pressing a second half of the foam strip into a second exposed portion of the window track so as to substantially fill the second exposed portion of the window track to prevent an accumulation of debris therein and yet not interfere with movement of the window.

13. A process for preventing an accumulation of debris in a window track, comprising the steps of:

measuring the length of the window track by stretching an elongate foam strip horizontally across the length of a window sill;

cutting the foam strip so that it is the length of the window track or slightly longer;

cutting the once measured and cut foam strip in half;

moving a horizontally sliding window to a first extreme open or close position;

pressing a first half of the foam strip into a first exposed portion of the window track to substantially fill the first portion of the window track to prevent an accumulation of debris therein and yet not interfere with movement of the window;

moving the sliding window to a second extreme open or close position; and pressing a second half of the foam strip into a second exposed portion of the window track so as to substantially fill the second exposed portion of the window track to prevent an accumulation of debris therein and yet not interfere with movement of the window.

* * * * *

UNITED STATES PATENT AND TRADEMARK OFFICE

CERTIFICATE OF CORRECTION

PATENT NO. : 5,291,687

DATED : March 8, 1994

INVENTOR(S) : Alex Abad

It is certified that error appears in the above-identified patent and that said Letters Patent is hereby corrected as shown below:

In column 5, line 47, delete "he" and insert --the--.

Signed and Sealed this

Twelfth Day of July, 1994

Bruce Lehman

*Attest:*

BRUCE LEHMAN

*Attesting Officer*

*Commissioner of Patents and Trademarks*